US011090957B2

(12) United States Patent
Fujiwara et al.

(10) Patent No.: US 11,090,957 B2
(45) Date of Patent: Aug. 17, 2021

(54) MEDIUM TRANSPORT DEVICE, RECORDING DEVICE, AND RECORDING METHOD

(71) Applicant: SEIKO EPSON CORPORATION, Tokyo (JP)

(72) Inventors: Daisuke Fujiwara, Matsumoto (JP); Takashi Akahane, Miyada-mura (JP)

(73) Assignee: Seiko Epson Corporation, Tokyo (JP)

( * ) Notice: Subject to any disclaimer, the term of this patent is extended or adjusted under 35 U.S.C. 154(b) by 48 days.

(21) Appl. No.: 16/584,578

(22) Filed: Sep. 26, 2019

(65) Prior Publication Data

US 2020/0101774 A1 Apr. 2, 2020

(30) Foreign Application Priority Data

Sep. 27, 2018 (JP) ..... JP2018-181436

(51) Int. Cl.
*B41J 15/16* (2006.01)
*B65H 23/188* (2006.01)
*B65H 23/16* (2006.01)

(52) U.S. Cl.
CPC ..... *B41J 15/16* (2013.01); *B41J 15/165* (2013.01); *B65H 23/16* (2013.01); *B65H 23/1888* (2013.01)

(58) Field of Classification Search
CPC ..... B41J 15/16; B41J 15/165; B65H 23/1888; B65H 23/188
See application file for complete search history.

(56) References Cited

U.S. PATENT DOCUMENTS

2015/0225196 A1* 8/2015 Hamano ..... B65H 18/26 242/473.4
2017/0087903 A1* 3/2017 Yamabe ..... B41J 15/16

FOREIGN PATENT DOCUMENTS

JP 2011-011889 1/2011
JP 2018-012599 1/2018
JP 2018-177468 11/2018

* cited by examiner

*Primary Examiner* — Henok D Legesse
(74) *Attorney, Agent, or Firm* — Workman Nydegger

(57) ABSTRACT

A transport device includes a transport roller configured to transport a roll paper, a winding unit configured to wind the roll paper transported, a tension applying unit configured to apply tension to the medium between the transport roller and the winding unit, and a control unit configured to control the tension applying unit. The control unit is configured to control the tension applying unit to maintain a state where the tension is released, at least during an acceleration period of rotation of the transport roller within a period in which the transport roller applies a transporting force to the roll paper.

8 Claims, 5 Drawing Sheets

MEDIUM TRANSPORT DEVICE, RECORDING DEVICE, AND RECORDING METHOD

The present application is based on, and claims priority from JP Application Serial Number 2018-181436, filed Sep. 27, 2018, the disclosure of which is hereby incorporated by reference in its entirety.

BACKGROUND

1. Technical Field

The present disclosure relates to a medium transport device that transports a medium having a long shape, a recording device including the medium transport device, and a recording method that uses the recording device.

2. Related Art

JP-A-2011-11889 describes a medium transport device used in a device that uses a medium having a long shape. This medium transport device is a device configured to transport a medium by applying tension to the medium, and is also configured to temporarily release the tension applied to the medium and subsequently apply tension again at a predetermined frequency. By temporarily releasing the tension applied to the medium, it is possible to make the medium sag, which causes the forcibly wound medium to unwind, and return a position of medium transport (displacement in a width direction of the medium) to an appropriate position. As a result, abnormal tension is no longer applied to the medium, making it possible to alleviate stress to the medium and reduce the occurrence of defects such as skew, medium floating, and wrinkles.

Nevertheless, in the medium transport device described in JP-A-2011-11889, while temporary release of the tension applied to the medium can, to a certain degree, correct the displacement that occurred in the width direction of the medium, the device is configured to transport the medium by applying tension to the medium and thus, depending on the degree of tension applied to the medium during transport, the problem arises that the occurrence of displacement itself during medium transport (displacement in the transport direction of the medium or displacement in the width direction of the medium) caused by the tension cannot be suppressed.

SUMMARY

A medium transport device of the present application includes a transport roller configured to transport a long medium, a winding unit configured to wind the medium transported, a tensioning applying unit configured to apply tension to the medium between the transport roller and the winding unit, and a control unit configured to control the tension applying unit. The control unit is configured to control the tension applying unit to maintain a state where the tension is released, at least during an acceleration period of rotation of the transport roller within a period in which the transport roller applies a transporting force to the medium.

In the medium transport device described above, the control unit may be configured to control the tension applying unit to maintain a state where the tension is released, in a constant-speed period of rotation of the transport roller and a deceleration period of rotation of the transport roller, in addition to the acceleration period.

In the medium transport device described above, the transport roller may be configured to start a transport operation of transporting the medium after the winding unit stops a winding operation of winding the medium.

In the medium transport device described above, the control unit may be configured to control the tension applying unit to apply tension to the medium until a predetermined amount of the medium transported is fully wound.

In the medium transport device described above, the tension applying unit may include a pair of arms configured to be pivotable, and a tension bar supported, at both end portions thereof, by pivoting ends of the pair of arms and configured to be separable from the medium.

In the medium transport device described above, the control unit may be configured to control the tension applying unit to maintain the tension bar at a predetermined position after the tension is released.

A recording device of the present application includes the medium transport device described above, and a recording unit configured to perform recording onto the medium.

A recording method of the present application is a recording method that uses a recording device including a transport roller configured to transport a long medium, a winding unit configured to wind the medium that was transported, a tension applying unit configured to apply tension to the medium between the transport roller and the winding unit, and a recording unit configured to perform recording onto the medium. The recording method includes controlling the tension applying unit to maintain a state where the tension is released, at least during an acceleration period of rotation of the transport roller within a period in which the transport roller applies a transporting force to the medium.

DESCRIPTION OF EXEMPLARY EMBODIMENTS

With reference to the drawings, a a description is given below of exemplary embodiments of the disclosure. The following are exemplary embodiments of the disclosure and are not intended to limit the disclosure. Note that the respective drawings may be illustrated not-to-scale, for illustrative clarity.

Exemplary Embodiment 1

Recording Device (Printer)

Figure 1:
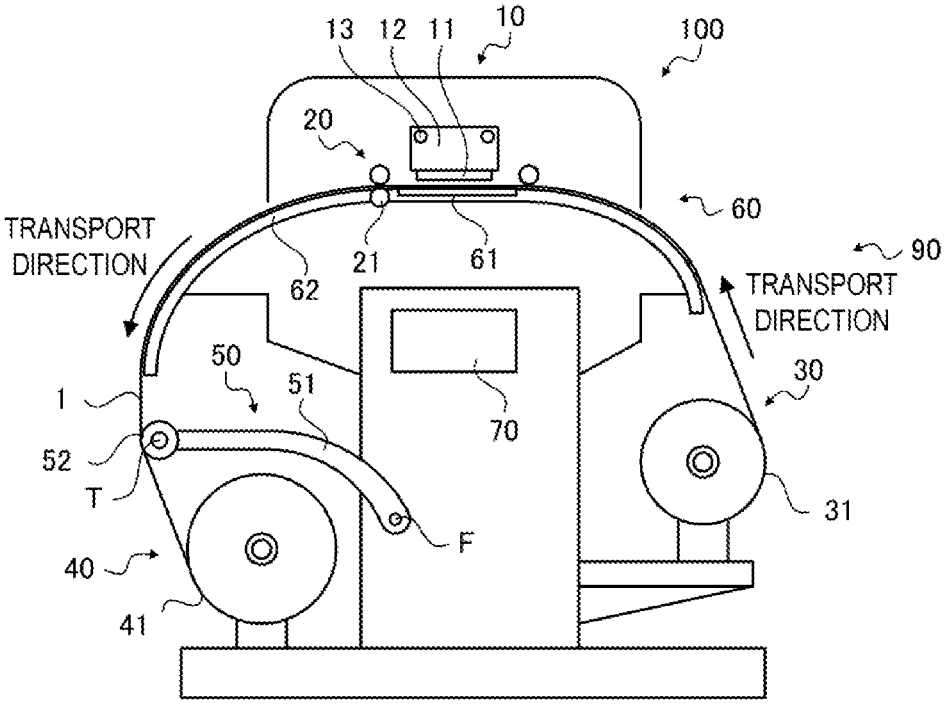
FIG. 1 is a schematic side view of a recording device according to exemplary embodiment 1.
Figure 2:
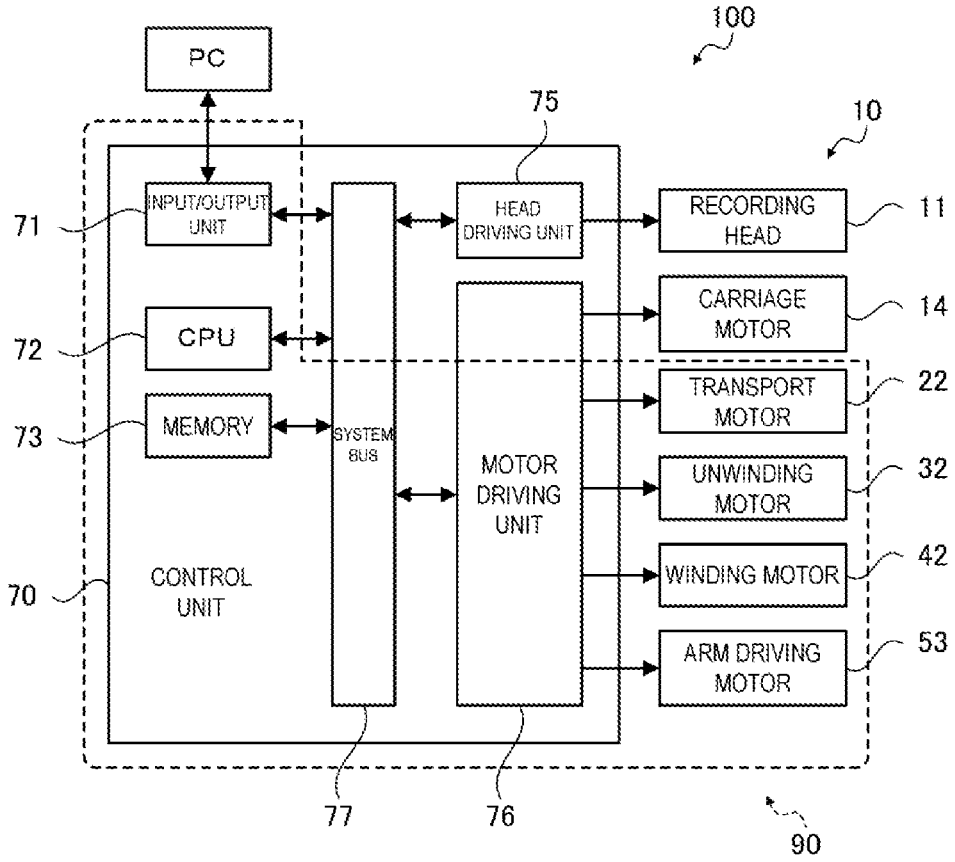
FIG. 2 is a block diagram of the recording device according to exemplary embodiment 1.

FIG. 1 is a schematic side view of a printer 100 as a "recording device" according to exemplary embodiment 1. FIG. 2 is a block diagram of the printer 100.

The printer 100 is an ink jet-type printer that records (prints) an image on a roll paper 1 supplied in a rolled state as a "long-shaped medium".

The printer 100 is constituted by a recording unit 10 that performs recording onto the roll paper 1, a transport device 90 serving as a "medium transport device" that transports the roll paper 1 along with the recording, and the like. The transport device 90 includes a transport unit 20, an unwinding unit 30, a winding unit 40, a tension applying unit 50, a transport support unit 60, a control unit 70, and the like.

Note that the control unit 70 also controls the recording unit 10. That is, the control unit 70, overall, controls the printer 100 in its entirety.

The roll paper 1 is supplied from the unwinding unit 30, is passed through the recording unit 10 by the transport support unit 60 along with the recording operation, and housed in the winding unit 40.

Woodfree paper, cast-coated paper, art paper, coated paper, synthetic paper, or a film formed of polyethylene terephthalate (PET), polypropylene (PP), or the like can be used as the roll paper 1, for example.

The recording unit 10 is constituted by a recording head 11, a carriage 12, a guide shaft 13, and the like. The recording head 11 is an ink jet head including a plurality of nozzles configured to discharge ink. The guide shaft 13 extends in a scanning direction intersecting with a transport direction in which the roll paper 1 moves. The recording head 11 is mounted on the carriage 12, and a carriage motor 14 (refer to FIG. 2) driven and controlled by the control unit 70 makes the carriage 12 to reciprocate (scan) along the guide shaft 13.

The control unit 70 forms (records) a desired image on the roll paper 1 by alternately repeating a discharge operation of discharging ink droplets from the recording head 11 while moving the carriage 12 in the scanning direction, and a transport operation of moving the roll paper 1 in the transport direction by the transport unit 20. That is, when performing recording onto the roll paper 1, the transport unit 20 intermittently transports the roll paper 1 by repeated transport operations.

Note that the recording unit 10 is configured by a serial head that reciprocates in the scanning direction as described above, but may have a line head configuration in which the nozzles configured to discharge ink are arranged across a width direction of the roll paper 1 in a direction intersecting the transport direction. Furthermore, the recording device may be a device including a recording unit other than a so-called ink jet-type recording head such as described above.

The transport unit 20 is a transport mechanism that applies a transporting force to the roll paper 1 and moves the roll paper 1 in the transport direction, and is constituted by a transport roller 21 provided with a nip roller and configured to rotate and drive the nip roller, and the like. The transport roller 21 is driven with the roll paper 1 interposed between the transport roller 21 and the nip roller, thereby transporting the roll paper 1 at a speed corresponding to a circumferential speed of the transport roller 21. That is, when there is no slippage between the transport roller 21 and the roll paper 1, the circumferential speed of the transport roller 21 is equivalent to the transport speed of the roll paper 1.

The transport roller 21 is driven by a transport motor 22 (refer to FIG. 2) driven and controlled by the control unit 70. Further, a rotary encoder (not illustrated) is provided to the transport roller 21.

Note that the transport unit 20 is not limited to the configuration described above and, for example, may have a configuration in which the transport roller 21 includes a transport belt. Further, the transport roller 21 need not necessarily include a nip roller, and may be configured to apply a transporting force to the roll paper 1 by, for example, rotating and driving the roll paper 1 in a state of being interposed between the transport roller 21 and a platen 61.

Further, to back-feed the roll paper 1, the transport unit 20 drives the transport roller 21 (transport motor 22) in reverse, making it possible to move the roll paper 1 in a reverse transport direction opposite to the transport direction. Such back-feeding is performed, for example, when superposition recording (printing) is further performed onto the recorded roll paper 1, when indexing (adjustment of a recording start position) is performed between recording (print) jobs, or when the roll paper 1, on which recording was completed across the entire surface, is wound back onto the unwinding unit 30, or the like.

The unwinding unit 30 is a housing unit that houses the roll paper 1 before recording is performed, is positioned upstream of the recording unit 10 in the transport support unit 60, and includes an unwinding reel 31 and the like.

The unwinding reel 31 is rotated by an unwinding motor 32 (refer to FIG. 2) driven and controlled by the control unit 70 to unwind the roll paper 1 toward the recording unit 10 disposed downstream of the unwinding unit 30.

Further, the unwinding unit 30 drives the unwinding reel 31 (unwinding motor 32) in reverse, making it possible to wind the roll paper 1 that was back fed.

The winding unit 40 is a housing unit that winds the roll paper 1 transported from the recording unit 10 and houses the roll paper 1 in a rolled state, is positioned downstream of the recording unit 10 in the transport path of the roll paper 1, and includes a winding reel 41, and the like.

The winding reel 41 includes a rotary shaft rotated by a winding motor 42 (refer to FIG. 2) driven and controlled by the control unit 70, and winds the roll paper 1 fed through the recording unit 10 with the rotary shaft as the axial center. A rotary encoder (not illustrated) is provided in the rotary shaft. Further, the winding unit 40 can unwind the roll paper 1 to be back fed by driving the winding reel 41 (winding motor 42) in reverse.

The tension applying unit 50 is a drive mechanism that applies tension to the roll paper 1 between the transport roller 21 and the winding unit 40. The tension applying unit 50 includes a pair of arms 51 configured to be pivotable about a pivoting shaft F, and a tension bar 52 supported by both end portions by pivoting ends T of the pair of arms 51 and extending in the width direction of the roll paper 1. Further, the tension applying unit 50 includes an arm driving motor 53 (refer to FIG. 2) that serves as a drive source configured to pivot the pair of arms 51. The arm driving motor 53 is driven and controlled by the control unit 70. A rotary encoder (not illustrated) is provided in the pivoting shaft F of the pair of arms 51.

The configuration of the mechanism for pivoting the pair of arms 51 by the arm driving motor 53 is not particularly limited. The pivoting shaft F may be directly pivoted by the arm driving motor 53, or may be configured to be pivoted via a gear or a belt.

The tension applying unit 50 can apply tension to the roll paper 1 by pivoting the pair of arms 51 and causing the tension bar 52 to come into contact with and press against the roll paper 1, and release the applied tension by pivoting the pair of arms 51 in reverse and separating the tension bar 52 from the roll paper 1.

The tension bar 52 includes a rotary shaft in the extending direction thereof, rotates along with the movement of the roll paper 1 that comes into contact with the tension bar 52, and supports the movement of the roll paper 1. Note that the tension bar 52 need not necessarily include such a rotary shaft, and may be a bar member that extends in the width direction of the roll paper 1 and supports the roll paper 1.

The transport support unit 60 is constituted by the platen 61 configured to support the roll paper 1 in a recording region of the recording unit 10, a medium support unit 62 configured to transport the roll paper 1 from the unwinding unit 30 to the winding unit 40 via the recording unit 10 or constituting a portion of the transport path for back-feeding in a reverse path, and the like.

As illustrated in FIG. 2, the control unit 70 includes an input/output unit 71, a central processing unit (CPU) 72, a memory 73, a head drive unit 75, a motor driving unit 76, a system bus 77, and the like, and carries out centralized control over the entire printer 100, including the tension applying unit 50.

The input/output unit 71 transmits and receives data between an external device (a personal computer PC, for example) and the printer 100.

The CPU 72 is an arithmetic processing device configured to perform overall control of the printer 100, and is coupled to the input/output unit 71, the memory 73, the head drive unit 75, and the motor driving unit 76 via the system bus 77.

The memory 73 is a region for storing a program run by the CPU 72 and recording necessary information, and is constituted by a storage element such as a random access memory (RAM), a read-only memory (ROM), or a flash memory.

The CPU 72 controls the head drive unit 75 and the motor driving unit 76 in accordance with a program stored in the memory 73 and a recording job (printing instruction) received from the external device.

The control unit 70 can recognize the rotational speed of the transport roller 21, the amount of movement of the roll paper 1 in the transport unit 20, the transport speed, and the like from the read values of the rotary encoder provided in the transport unit 20 (transport roller 21).

Further, the control unit 70 can recognize the amount of movement, the winding speed, and the like of the roll paper 1 in the winding unit 40 from the read values of the rotary encoder provided in the winding unit 40 (winding reel 41).

Furthermore, the control unit 70 can recognize the pivoting speed, the amount of pivoting, the position of the tension bar 52, and the like of the pair of arms 51 from the read values of the rotary encoder provided in the tension applying unit 50 (pair of arms 51).

In the transport device 90 having the configuration described above and the printer 100 including the transport device 90, the control unit 70 controls the tension applying unit 50 to maintain a state of tension being released at least during an acceleration period of rotation of the transport roller 21 within a period of the transport roller 21 applying a transporting force to the roll paper 1.

Details will be described below.

Figure 3:
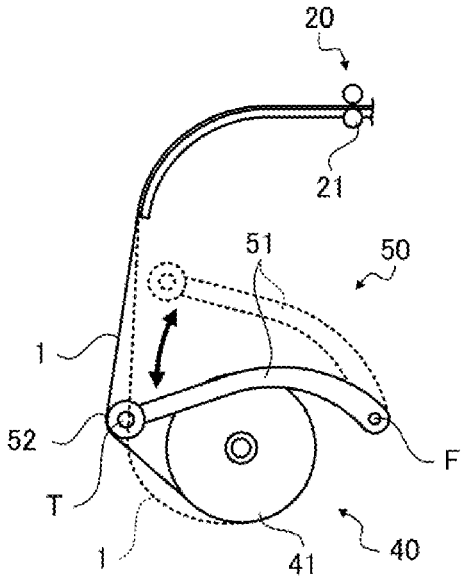
FIG. 3 is a schematic view illustrating the operation of a tension applying unit.

FIG. 3 is a schematic view illustrating the operation of the tension applying unit 50.

Figure 4:
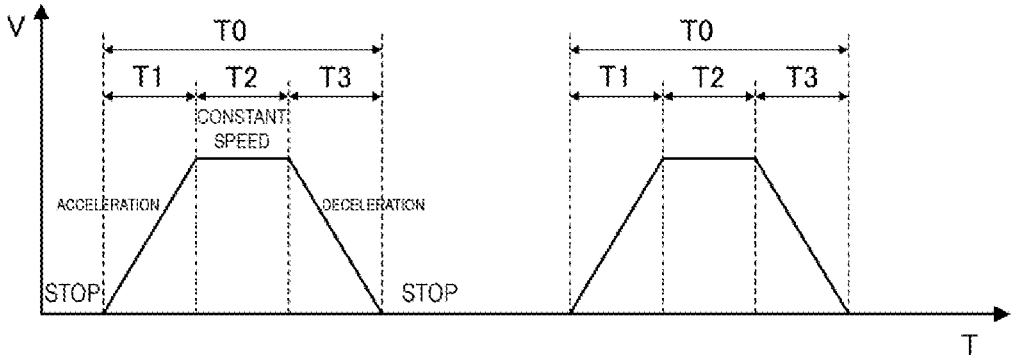
FIG. 4 is a graph schematically illustrating changes in a rotational speed of a transport roller in a transport operation.
Figure 5:
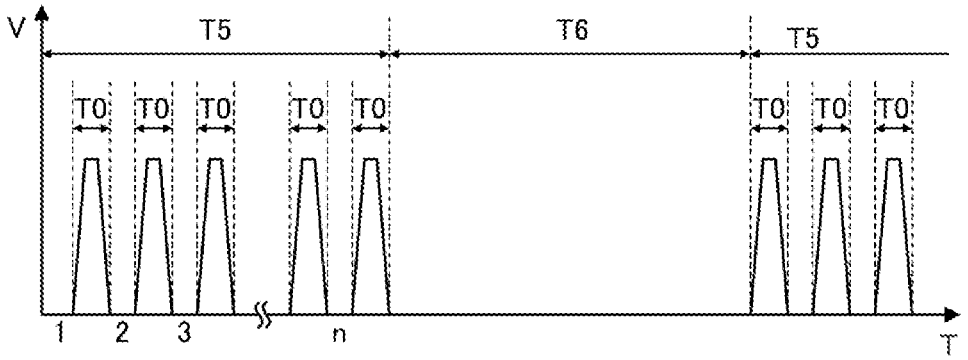
FIG. 5 is a graph schematically illustrating changes in the rotational speed of the transport roller in the transport operation.

Further, FIG. 4 and FIG. 5 are graphs schematically illustrating changes in a rotational speed V of the transport roller 21 in the repeated transport operation.

As illustrated in FIG. 3, in a state in which the transport roller 21 is stopped, the tension applying unit 50 can apply tension to the roll paper 1 by pivoting the pair of arms 51 in a direction in which the tension bar 52 approaches the winding reel 41 (a direction in which the tension bar 52 separated from the roll paper 1 comes into contact with the roll paper 1), and causing the tension bar 52 to come into contact with and press against the roll paper 1 from an inner side of the roll paper 1 to be wound onto the winding unit 40.

Further, from a state in which tension is applied to the roll paper 1, the tension applying unit 50 can release the tension applied to the roll paper 1 by pivoting the pair of arms 51 in reverse to the above, and separating the tension bar 52 from the roll paper 1 (by pivoting the pair of arms 51 to the position indicated by the dashed line in the example illustrated in FIG. 3).

Further, the control unit 70 controls the tension applying unit 50 so that, after the tension is released, the tension bar 52 is fixed at a predetermined position. In other words, the control unit 70 is configured to control the tension applying unit 50 to maintain the tension bar 52 at a predetermined position after the tension is released. Performing control so that the tension bar 52 is fixed at a predetermined position specifically refers to performing control to prevent the tension bar 52 from coming into contact with the roll paper 1 again due to vibration of the pair of arms 51 after pivoting in the tension release operation, for example.

Accordingly, proportional-integral-differential (PID) control may be used for driving and controlling the arm driving motor 53, that is, controlling the position of the tension bar 52, for example.

Further, the predetermined position refers to a position at which separation from the roll paper 1 can be maintained, and when tension is applied to the roll paper 1 again, a position that does not require more time than necessary to pivot the pair of arms 51.

With such a configuration of the tension applying unit 50, the control unit 70 controls the tension applying unit 50 to maintain a state of tension being released at least during the acceleration period of rotation of the transport roller 21 within the period of the transport roller 21 applying a transporting force to the roll paper 1. Here, the period of the transport roller 21 applying a transporting force to the roll paper 1 refers to a period of the transport roller 21 rotating with the roll paper 1 interposed between the transport roller 21 and the nip roller, and the roll paper 1 being moved (an attempt is made to move the roll paper 1) in the transport direction. As illustrated in FIG. 4, the period of the transport roller 21 applying a transporting force to the roll paper 1 (a transport period T0) includes an acceleration period T1 in which the transport roller 21 is accelerated from a stopped state to a state of rotation at a constant speed, a constant-speed period T2 in which rotation is continued at a constant speed, and a deceleration period T3 in which the transport roller 21 is decelerated from a state of rotation at a constant speed to a stopped state.

Note that the acceleration in the acceleration period T1 and the deceleration period T3 need not be constant (linear) as illustrated in FIG. 4, and the rotational speed of the transport roller 21 in the constant-speed period T2 need not be strictly a constant speed. Further, the period of transition from the acceleration period T1 to the deceleration period T3 may be considered the constant-speed period T2.

Within the transport period T0 in which the transport roller 21 applies a transporting force to the roll paper 1, the acceleration period T1 of rotation of the transport roller 21 (particularly, the timing at which the transport roller 21 transitions from a stationary state to a movement state) is a period in which slippage tends to occur between the roll paper 1 and the transport roller 21. Thus, at least during the acceleration period T1 of rotation of the transport roller 21 within the transport period T0 in which the transport roller 21 applies a transporting force to the roll paper 1, the control unit 70 controls the tension applying unit 50 and maintains a state of the tension being released against the roll paper 1 by separating the tension bar 52 from the roll paper 1. A state of the tension being released refers to controlling the tension applying unit 50 so that the state transitions from the tension applying unit 50 applying tension to the roll paper 1 upon contact with the roll paper 1 to the tension applying unit 50 not applying tension to the roll paper 1 upon separation from the roll paper 1. In the acceleration period T1 of rotation of the transport roller 21, the slippage that occurs between the roll paper 1 and the transport roller 21 can be suppressed by maintaining a state of tension being released against the roll paper 1. The slippage suppressed here is, for example, slippage caused by excessive front tension applied to the roll paper 1, uneven front tension in the width direction of the roll paper 1, and the like. As a result of suppression of such slippage, it is possible to further increase a transport accuracy (reduce a degree of deviation from a predetermined transport specification). For example, the occurrence of transport position displacement, skew caused by transport position displacement, and the like are suppressed.

Note that the operation of separating the tension bar 52 from the roll paper 1, that is, the operation of pivoting the pair of arms 51, may be controlled so that the tension applied to the roll paper 1 is gradually released and completed before the acceleration period T1 of rotation of the transport roller 21 is reached.

Additionally, after the tension is released, the state of the tension being released may be regarded as maintained as long as the tension bar 52 maintains a state of being separated from the roll paper 1, even when a distance between the tension bar 52 and the roll paper 1 changes over time.

Here, as a result of the control unit 70 controlling the tension applying unit 50 so that the tension bar 52 is separated from the roll paper 1 in the acceleration period T1 of rotation of the transport roller 21, the tension bar 52 may come into contact with the roll paper 1 for a minute period starting from the beginning of the acceleration period T1. Specifically, there may be a situation in which the tension is not fully released such as, for example, in a delay period of pivoting caused by inertia of the pair of arms 51, or a period in which contact continues as the roll paper 1 moves in the same direction along with the movement of the tension bar 52 in a direction away from the roll paper 1. However, the minute period here refers to a period sufficiently shorter than the acceleration period T1. In such a state, as long as the occurrence of transport position displacement, skew caused by transport position displacement, and the like are suppressed, this can be a control to a state of tension being released. Further, here, the control to a state of tension being released includes the concept related to the state of contact and the state of separation of the tension bar 52 against the roll paper 1 described above as well as the following concept. That is, the control to a state of tension being released is a concept that includes, in the control performed by the control unit 70 for separating the tension bar 52 from the roll paper 1, during the period extending from before the acceleration period T1 of rotation of the transport roller 21 is reached until the acceleration period T1 of rotation of the transport roller 21 is reached, outputting a signal for reducing a driving torque of the arm driving motor 53 for causing the tension bar 52 to come into contact with and press against the roll paper 1 from the control unit 70. Alternatively, the concept includes reducing the output current (output voltage) from the arm driving motor 53 as a result of the arm driving motor 53 being controlled based on the signal output from the control unit 70 in the acceleration period T1 of rotation of the transport roller 21. Further, "reducing" here refers to the driving torque of the arm driving motor 53 being reduced continuously or incrementally further than that in the state before the acceleration period T1 of rotation of the transport roller 21. With the driving torque continuously or incrementally reduced, the tension applied to the roll paper 1 is gradually released. Note that the driving torque of the arm driving motor 53 is proportional to the output current from the arm driving motor 53.

Further, to maintain a state of tension being released includes the concept of controlling the tension applying unit 50 so that the position of the tension bar 52 is fixed at a predetermined position as well as the concept of maintaining a state of tension being released by controlling the driving torque of the arm driving motor 53. For example, the control unit 70 outputs a signal for reducing the driving torque of the arm driving motor 53 during the period extending from before the acceleration period T1 of the rotation of the transport roller 21 is reached until the acceleration period T1 of the rotation of the transport roller 21 is reached. Next, the control unit 70 continues the state in which the driving torque of the arm driving motor 53 is continuously or incrementally reduced at least during the acceleration period T1 of rotation of the transport roller 21. That is, from the state in which the driving torque of the arm driving motor 53 was continuously or incrementally reduced, the driving torque of the arm driving motor 53 is not increased. At this time, by measuring the output signal from the control unit 70 or measuring the output current (output voltage) from the arm driving motor 53, it is possible to directly or indirectly observe whether the driving torque of the arm driving motor 53 has been reduced. Further, when the driving torque of the arm driving motor 53 is not reduced, that is, when the tension is not released according to the observation results, the operation of releasing the tension can be performed.

Note that, even in the transport operation in the constant-speed period T2 and the deceleration period T3 as well as the acceleration period T1, when a state of tension is being applied to the roll paper 1, slippage may occur between the roll paper 1 and the transport roller 21 depending on the tension. Thus, the control unit 70 may control the tension applying unit 50 so that a state of tension being released is maintained in the constant-speed period T2 and the deceleration period T3 of rotation of the transport roller 21 in addition to the acceleration period T1. That is, a state of tension being released may be maintained for all periods in which the transport roller 21 applies a transporting force to the medium, without limitation to the acceleration period T1.

Further, the control unit 70 records onto the roll paper 1 by performing control in which a discharge operation of discharging ink droplets from the recording head 11 while moving the carriage 12 in the scanning direction with the roll paper 1 in a stopped state, and a transport operation of rotating the transport roller 21 to apply a transporting force to the roll paper 1 and transport the roll paper 1 are alternately repeated. Furthermore, the control unit 70 controls the recording unit 10, the transport unit 20, the unwinding unit 30, and the winding unit 40, and repeatedly performs recording and a winding operation. The recording is performed on a predetermined amount (predetermined length) of the roll paper 1 by repeating a predetermined number of discharge operations and transport operations, and the winding operation is performed by winding a predetermined amount of roll paper 1 on which recording was completed.

FIG. 5 shows situations of the changes in the rotational speed V of the transport roller 21 in a recording period T5 in which the discharge operation and the transport operation are repeated a predetermined number of times (n times) and recording is performed onto a predetermined amount of the roll paper 1, and the existence of a recording stop period T6 in which the rotation of the transport roller 21 is stopped across a plurality of the recording periods T5.

While the control unit 70 may control the 50 so that a state of tension being released is maintained in the constant-speed period T2 and the deceleration period T3 of rotation of the transport roller 21 in addition to the acceleration period T1 (that is, the transport period T0) as described above, the control unit 70 may further control the tension applying unit 50 so that a state of tension being released is maintained across the entire recording period T5, including the discharge operation period between each transport period T0. With such control, there is no need for the tension applying unit 50 to repeated apply and release tension in the recording period T5.

Further, in the recording stop period T6, the winding operation of the roll paper 1 by the winding unit 40 is performed. In this winding operation, winding may be performed without slack, and thus the control unit 70 stops the transport operation by the transport unit 20, controls the tension applying unit 50, and applies the necessary tension to the roll paper 1 between the transport roller 21 and the winding unit 40.

Note that the timing at which each of the drive units, specifically the transport motor 22, the unwinding motor 32, the winding motor 42, and the arm driving motor 53, are driven by the control of the control unit 70 may be determined upon sufficient evaluation. The timing at which these are driven specifically refers to the timing at which transport is performed by the transport unit 20 (the timing of the start and the end of the transport operation), the timing at which winding is performed by the winding unit 40 (the timing of the start and the end of the winding operation), and the timing at which tension is applied by the tension applying unit 50 (the timing of the start and the end of the tension applying operation, the timing of the start and the end of the tension release operation), and the like.

For example, control may be performed so that, after the winding unit 40 stops the winding operation of winding the roll paper 1, the transport roller 21 starts the transport operation of transporting the roll paper 1. That is, the control unit 70 starts the transport operation in a state after the winding unit 40 has stopped the winding operation of winding the roll paper 1, and controls the tension applying unit 50 so that a state of tension being released is maintained at least during the acceleration period T1 of rotation of the transport roller 21, during the transport period T0 in which the transport roller 21 applies a transporting force to the roll paper 1, or during the recording period T5 in which recording is performed onto a predetermined amount of the roll paper 1. Thus, during the period in which tension is released by the tension applying unit 50, tension is not newly applied by the winding operation of the winding unit 40. As a result, slippage that occurs between the roll paper 1 and the transport roller 21 can be suppressed more effectively and more stably.

Note that, as long as the tension applied to the roll paper 1 is released (as long as the state of the tension being released is maintained) at the timing when the transport roller 21 starts the transport operation of transporting the roll paper 1 (at the timing of the start of the acceleration period T1) by controlling the drive timing of the tension applying unit 50, control may be performed so that the transport roller 21 starts the transport operation of transporting the roll paper 1 before the winding unit 40 stops the winding operation of winding the roll paper 1.

Further, in the recording stop period T6, that is, in the period in which the transport operation is not performed, the winding operation of the roll paper 1 by the winding unit 40 is performed and the tension applying unit 50 is controlled to apply the necessary tension to the roll paper 1 between the transport roller 21 and the winding unit 40. Here, the control unit 70 may control the tension applying unit 50 so that tension is applied to the roll paper 1 until a predetermined amount of the roll paper 1 transported is fully wound. Specifically, for example, after the recording period T5, the control unit 70 controls the tension applying unit 50 so that tension is applied to the roll paper 1, subsequently starts the winding of the roll paper 1 and, upon completion of the winding of the roll paper 1, releases the applied tension. Thus, at least the tension applying unit 50 is controlled so that tension is applied to the roll paper 1 until the roll paper 1 is fully wound, making it possible to suppress slack in the winding.

As a recording method in this exemplary embodiment, a recording method uses the printer 100 and includes recording by controlling the 50 so that a state of tension being released is maintained at least during the acceleration period T1 of rotation of the transport roller 21 within the period of the transport roller 21 applying a transporting force to the roll paper 1.

As described above, according to the medium transport device, the recording device, and the recording method according to the exemplary embodiments, the effects below can be achieved.

The acceleration period T1 of rotation of the transport roller 21, within the period in which the transport roller 21 applies a transporting force to the roll paper 1, is a period in which slippage tends to occur between the roll paper 1 and the transport roller 21. As a result, at least during the acceleration period T1 of rotation of the transport roller 21 within the period in which the transport roller 21 applies a transporting force to the roll paper 1, the slippage that occurs between the roll paper 1 and the transport roller 21 can be suppressed by maintaining a state of tension being released against the roll paper 1. The slippage suppressed here is, for example, slippage caused by excessive front tension applied to the roll paper 1, uneven front tension in the width direction of the roll paper 1, and the like. As a result of suppression of such slippage, it is possible to further increase a transport accuracy (reduce a degree of deviation from a predetermined transport specification). For example, the occurrence of transport position displacement, skew, and the like are suppressed.

Further, the slippage that occurs between the roll paper 1 and the transport roller 21 can be suppressed by maintaining a state of tension being released in the transport period T0 in which the transport roller 21 applies a transporting force to the roll paper 1.

Further, the transport roller 21 starts the transport operation of transporting the roll paper 1 after the winding unit 40 stops the winding operation of winding the roll paper 1 (that is, the transport operation is started in a state after the winding unit 40 stops the winding operation of winding the roll paper 1, and the tension applying unit 50 is controlled to maintain a state of tension being released at least during the acceleration period T1 of rotation of the transport roller 21 or during the transport period T0 in which the transport roller 21 applies a transporting force to the roll paper 1), and thus tension is not newly applied by the winding operation of the winding unit 40 in the period in which tension is released by the tension applying unit 50. As a result, slippage that occurs between the roll paper 1 and the transport roller 21 can be suppressed more effectively and more stably.

Further, tension is applied again to the roll paper 1 until a predetermined amount of the transported roll paper 1 is fully wound, making it possible to suppress slack in the winding.

Further, the tension applying unit 50 includes the pair of arms 51 configured to pivot, and the tension bar 52 supported by both end portions by pivoting ends T of the pair of arms 51 and configured to separate from the roll paper 1. Thus, by controlling the pivoting and pivoting angle of the pair of arms 51, it is possible to control the strength of the tension applied by the tension bar 52 that comes into contact with the roll paper 1. Further, the tension bar 52 can be separated from the roll paper 1, making it possible to release the tension applied by the tension applying unit 50 to the roll paper 1.

Further, the control unit 70 controls the tension applying unit 50 so that, after the tension is released, the tension bar 52 is fixed at a predetermined position. As a result, the tension bar 52 is kept from coming into contact with the roll paper 1 again due to vibration of the pair of arms 51 in the tension release operation or the like, for example. That is, the released state can be stably maintained.

Further, the printer 100 includes the transport device 90 and the recording unit 10. With provision of the transport device 90, the long-shaped roll paper 1 on which recording is to be performed is transported with higher accuracy, skew and the like are suppressed, and thus deviation and distortion of the recorded image and the occurrence of wrinkles in the wound roll paper 1 are suppressed.

Further, in the recording method using the printer 100, at least during the acceleration period T1 of rotation of the transport roller 21 within the period in which the transport roller 21 applies a transporting force to the roll paper 1, the tension applied to the roll paper 1 is released. As a result, slippage that occurs between the roll paper 1 and the transport roller 21 is suppressed and, as a result, recording can be performed on the roll paper 1 transported with higher transport accuracy.

In addition, the present disclosure is not limited to the exemplary embodiments described above, which may be variously changed and modified. Such modifications will be described below.

Modification 1

Figure 6:
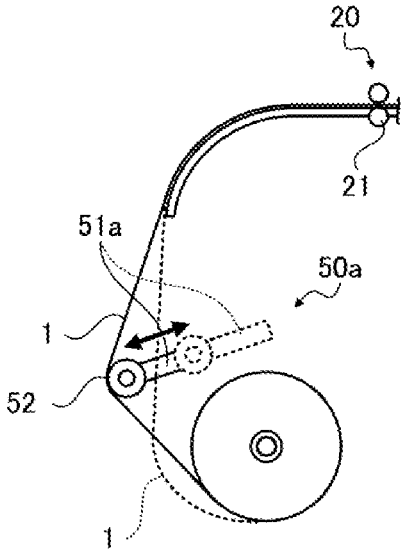
FIG. 6 is a schematic view illustrating a configuration of the tension applying unit according to modification 1.

FIG. 6 is a schematic view illustrating a configuration of a tension applying unit 50*a* according to modification 1.

While, in the configuration of the tension applying unit 50 of exemplary embodiment 1, the tension bar 52 is described as being supported by the pivoting ends T of the pair of arms 51 configured to pivot as illustrated in FIG. 3, the configuration is not limited thereto. For example, as illustrated in FIG. 6, the tension bar 52 may be configured to be supported by a pair of arms 51*a* being extendable and retractable.

The driving unit that drives the pair of arms 51*a* in an extendable and retractable manner can be constituted by a hydraulic or ball screw driving mechanism, for example.

The tension applying unit 50*a* can apply tension to the roll paper 1 by extending the pair of arms 51*a* and causing the tension bar 52 to come into contact with and press against the roll paper 1, and can release the applied tension by retracting the pair of arms 51*a* and separating the tension bar 52 from the roll paper 1.

Even with such a configuration, effects may be obtained similarly to exemplary embodiment 1.

Modification 2

Figure 7:
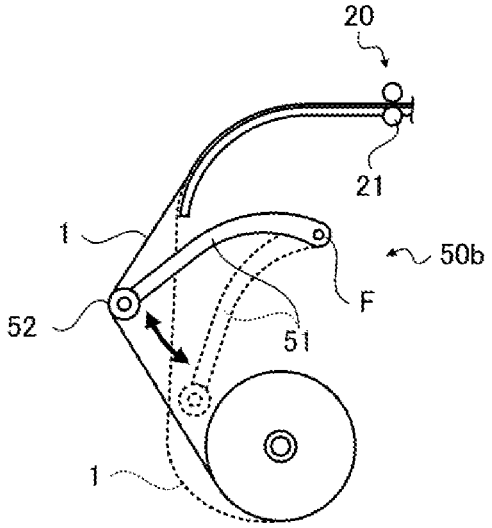
FIG. 7 is a schematic view illustrating a configuration of the tension applying unit according to modification 2.

FIG. 7 is a schematic view illustrating a configuration of a tension applying unit 50*b* according to modification 2.

While a description is given in exemplary embodiment 1 of the tension bar 52 separated from the roll paper 1 being moved in a direction of contact with the roll paper 1 by pivoting the pair of arms 51 in a direction in which the tension bar 52 approaches the winding reel 41 as illustrated in FIG. 3, the configuration is not limited thereto. For example, the tension bar 52 separated from the roll paper 1 may be configured to be moved in a direction of contact with the roll paper 1 by pivoting the pair of arms 51 in a direction that separates the tension bar 52 from the winding reel 41 as illustrated in FIG. 7.

Even with such a configuration, the following effects may be obtained similarly to exemplary embodiment 1.

Contents derived from the exemplary embodiments will be described below.

A medium transport device of the present application includes a transport roller configured to transport a long medium, a winding unit configured to wind the medium transported, a tension applying unit configured to apply tension to the medium between the transport roller and the winding unit, and a control unit configured to control the tension applying unit. The control unit is configured to control the tension applying unit to maintain a state where the tension is released, at least during an acceleration period of rotation of the transport roller within a period in which the transport roller applies a transporting force to the medium.

According to this configuration, the acceleration period of rotation of the transport roller within the period of the transport roller applying a transporting force to the medium is a period in which slippage tends to occur between the medium and the transport roller. As a result, at least during the acceleration period of rotation of the transport roller within the period of the transport roller applying a transporting force to the medium, slippage that occurs between the medium and the transport roller can be suppressed by maintaining a state of the tension being released from the medium. The slippage suppressed here is, for example, slippage caused by excessive front tension applied to the medium, uneven front tension in the width direction of the medium, and the like. As a result of suppression of such slippage, it is possible to further increase the transport accuracy (reduce the degree of deviation from a predetermined transport specification). For example, the occurrence of transport position displacement, skew, and the like are suppressed.

In the medium transport device described above, the control unit is configured to control the tension applying unit to maintain a state where the tension is released, in a constant speed period of rotation of the transport roller and a deceleration period of rotation of the transport roller, in addition to the acceleration period.

According to this configuration, in all periods in which the transport roller applies a transporting force to the medium, slippage that occurs between the medium and the transport roller can be suppressed by maintaining a state of the tension being released. The slippage suppressed here is, for example, slippage caused by excessive front tension applied to the medium, uneven front tension in the width direction of the medium, and the like, similar to the description above.

As a result of suppression of such slippage, it is possible to further increase the transport accuracy (reduce the degree of deviation from a predetermined transport specification). For example, the occurrence of transport position displacement, skew, and the like are suppressed.

In the medium transport device described above, the transport roller may be configured to start a transport operation of transporting the medium after the winding unit stops a winding operation of winding the medium.

According to this configuration, the transport roller starts the transport operation of transporting the medium after the winding unit stops the winding operation of winding the medium. That is, in a state after the winding unit stops the winding operation of winding the medium, the control unit controls the tension applying unit so that a state of the tension being released is maintained in the acceleration period of rotation of the transport roller or in all periods in which the transport roller applies a transporting force to the medium. As a result, in a period in which tension is released by the tension applying unit, tension is not newly applied by the winding operation of the winding unit. As a result, slippage that occurs between the medium and the transport roller can be suppressed more effectively and more stably.

In the medium transport device described above, the control unit may be configured to control the tension applying unit to apply tension to the medium until a predetermined amount of the medium transported is fully wound.

According to this configuration, tension is applied again to the medium until a predetermined amount of the medium transported is fully wound, making it possible to suppress slack in the winding.

In the medium transport device described above, the tension applying unit may include a pair of arms configured to be pivotable, and a tension bar supported, at both end portions thereof, by pivoting ends of the pair of arms and configured to be separable from the medium.

According to this configuration, by controlling the pivoting and pivoting angle of the pair of arms, it is possible to control the strength of the tension applied by the tension bar that comes into contact with the medium. Further, the tension bar can be separated from the medium, making it possible to release the tension applied by the tension applying unit.

In the medium transport device described above, the control unit may be configured to control the tension applying unit to maintain the tension bar at a predetermined position after the tension is released.

According to this configuration, the control unit controls the tension applying unit, after the tension is released, to cause the tension bar to be fixed in a predetermined position. As a result, the tension bar is kept from coming into contact with the medium again due to vibration of the pair of arms in the tension release operation or the like, for example. That is, the released state can be stably maintained.

A recording device of the present application includes the medium transport device described above, and a recording unit configured to perform recording onto the medium.

According to this configuration, the long-shaped medium on which recording is to be performed is transported with higher accuracy, skew and the like are suppressed, and thus deviation and distortion of the recorded image and the occurrence of wrinkles in the wound medium are suppressed.

A recording method of the present application is a recording method that uses a recording device including a transport roller configured to transport a long medium, a winding unit configured to wind the medium that is transported, a tension applying unit configured to apply tension to the medium between the transport roller and the winding unit, and a recording unit configured to perform recording onto the medium. The recording method includes controlling the tension applying unit to maintain a state where the tension is released, at least during an acceleration period of rotation of the transport roller within a period in which the transport roller applies a transporting force to the medium.

According to this recording method, at least during the acceleration period of rotation of the transport roller within the period of the transport roller applying a transporting force to the medium, slippage that occurs between the medium and the transport roller can be suppressed by maintaining a state of the tension being released from the medium. As a result, recording can be performed onto the medium transported at a higher transport accuracy.

What is claimed is:

1. A medium transport device comprising:

a transport roller configured to transport a long medium;

a winding unit configured to wind the medium transported;

a tension applying unit configured to apply tension to the medium between the transport roller and the winding unit; and a control unit configured to control the tension applying unit, wherein the control unit is configured to control the tension applying unit to maintain a state where the tension is released, at least during an acceleration period of rotation of the transport roller within a period in which the transport roller applies a transporting force to the medium, and wherein during a winding operation where the winding unit winds the medium, the control unit is configured to control the tension applying unit to maintain a state where the tension is applied to the medium.

2. The medium transport device according to claim 1, wherein the control unit is configured to control the tension applying unit to maintain a state where the tension is released, in a constant-speed period of rotation of the transport roller and a deceleration period of rotation of the transport roller, in addition to the acceleration period.

3. The medium transport device according to claim 1, wherein the transport roller is configured to start a transport operation of transporting the medium after the winding unit stops a winding operation of winding the medium.

4. The medium transport device according to claim 1, wherein the control unit is configured to control the tension applying unit to apply tension to the medium until a predetermined amount of the medium transported is fully wound.

5. The medium transport device according to claim 1, wherein the tension applying unit includes a pair of arms configured to be pivotable, and a tension bar supported, at both end portions thereof, by pivoting ends of the pair of arms and configured to be separable from the medium.

6. The medium transport device according to claim 5, wherein the control unit is configured to control the tension applying unit to maintain the tension bar at a predetermined position after the tension is released.

7. A recording device comprising:

the medium transport device according to claim 1; and a recording unit configured to perform recording onto the medium.

8. A recording method using a recording device including a transport roller configured to transport a long medium, a winding unit configured to wind the medium transported, a tension applying unit configured to apply tension to the medium between the transport roller and the winding unit, and a recording unit configured to perform recording onto the medium, the recording method comprising:

controlling the tension applying unit to maintain a state where the tension is released, at least during an acceleration period of rotation of the transport roller within a period in which the transport roller applies a transporting force to the medium; and controlling the tension applying unit to maintain a state where the tension is applied to the medium during a winding operation where the winding unit winds the medium.

* * * * *